US007981224B2

(12) United States Patent
Kawano et al.

(10) Patent No.: US 7,981,224 B2
(45) Date of Patent: Jul. 19, 2011

(54) MULTI-PHASE STEEL SHEET EXCELLENT IN HOLE EXPANDABILITY AND METHOD OF PRODUCING THE SAME

(75) Inventors: Osamu Kawano, Oita (JP); Takehiro Hoshino, Oita (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/741,607

(22) Filed: Dec. 18, 2003

(65) Prior Publication Data

US 2005/0133124 A1 Jun. 23, 2005

(51) Int. Cl.
*C22C 38/02* (2006.01)

(52) U.S. Cl. ..... 148/320; 148/332; 148/333; 148/334; 148/335; 148/336; 148/337; 148/548

(58) Field of Classification Search ..... 148/546, 148/332–337, 320
See application file for complete search history.

(56) References Cited

U.S. PATENT DOCUMENTS 5,470,529 A * 11/1995 Nomura et al. ..... 420/103
6,818,074 B2 * 11/2004 Matsuoka et al. ..... 148/332

FOREIGN PATENT DOCUMENTS

| | | | |
|---|---|---|---|
| EP | 0 997 548 A1 | | 5/2000 |
| EP | 1 201 780 A1 | | 5/2002 |
| JP | 59-219473 | | 12/1984 |
| JP | 03-180426 | | 8/1991 |
| JP | 05-163590 | | 6/1993 |
| JP | 08176661 A | * | 7/1996 |
| JP | 408176661 | * | 7/1996 |
| JP | 09-104947 | | 4/1997 |
| JP | 10-060593 | | 3/1998 |
| JP | 11217622 A | * | 8/1999 |
| JP | 2000-008136 | | 1/2000 |
| JP | 2001-107133 | | 4/2001 |

(Continued)

OTHER PUBLICATIONS

Patent Abstracts of Japan, vol. 1996, No. 02, Feb. 29, 1996 & JP 07 252592 A, Oct. 3, 1995.

(Continued)

*Primary Examiner* — Alexa D. Neckel
*Assistant Examiner* — Nicholas A. Smith
(74) *Attorney, Agent, or Firm* — Kenyon & Kenyon LLP

(57) ABSTRACT

The present invention provides a steel sheet excellent in both a balance between strength and elongation and a balance between strength and hole expandability, in other words, a multi-phase steel sheet having an excellent balance between strength and hole expandability.

The present invention is a multi-phase steel sheet excellent in hole expandability characterized in that:

the steel sheet contains, as chemical components in mass, C: 0.03 to 0.15%, P: not more than 0.010%, S: not more than 0.003%, and either one or both of Si and Al in a total amount of 0.5 to 4%, and one or more of Mn, Ni, Cr, Mo and Cu in a total amount of 0.5 to 4%, with the balance consisting of Fe and unavoidable impurities;

the microstructure at a section of the steel sheet is composed of either one or both of retained austenite and martensite which account(s) for 3 to 30% in total in area percentage and the balance consisting of either one or both of ferrite and bainite;

the maximum length of the crystal grains in the microstructure is not more than 10 microns; and the number of inclusions 20 microns or larger in size at a section of the steel sheet is not more than 0.3 piece per square millimeter.

6 Claims, 3 Drawing Sheets

FOREIGN PATENT DOCUMENTS

| | | | |
|---|---|---|---|
| JP | 2002115025 | * | 4/2002 |
| JP | 2002129285 | * | 5/2002 |
| WO | WO 99/46418 | | 9/1999 |

OTHER PUBLICATIONS

Patent Abstracts of Japan, vol. 2000, No. 6, Sep. 22, 2000 & JP 2000 087144 A (NKK Corp), Mar. 28, 2000.

Patent Abstracts of Japan, vol. 2000, No. 1, Jan. 31, 2000 & JP 11 279694 A (Nippon Steel Corp), Oct. 12, 1999.

"Effect of Cu on Property of Steel," from *Steel and Alloy Elements*, (vol. 1) 19$^{th}$ Committee of Steelmaking, Japan Society for Promotion of Science, Seibundo Shinkosha Publishing Co., Ltd., Tokyo, Japan, Dec. 6, 1971, pp. 378, 379, with English translation.

* cited by examiner

MULTI-PHASE STEEL SHEET EXCELLENT IN HOLE EXPANDABILITY AND METHOD OF PRODUCING THE SAME

TECHNICAL FIELD

The present invention relates to a multi-phase steel sheet excellent in hole expandability, aiming at the application for automobiles, such as passenger cars and trucks, etc., for industrial machines, or the like, and a method of producing the same.

BACKGROUND ART

In recent years, demands for high strength steel sheets have been growing with the increasing needs mainly for the weight reduction of automobile bodies and the assurance of the safety of passengers in a collision. In particular, the application of steels of TS 590 MPa class (60 kgf/mm$^2$ class) in tensile strength has rapidly expanded.

As a steel sheet used for such application, a multi-phase steel sheet comprising retained austenite and/or martensite is widely known. For example, as Japanese Unexamined Patent Publication No. H9-104947 discloses, a steel sheet having an excellent balance between strength and elongation (a total elongation is 33.8 to 40.5% when a tensile strength is 60 to 69 kgf/mm$^2$) is obtained by containing retained austenite in an appropriate quantity therein. In this technology, however, a technology regarding the balance between strength and hole expandability has not been sufficiently considered and, in particular, technological requirements for ultra-low P, the control of the maximum length of a microstructure and inclusions and the control of the hardness of a microstructure are not, in the least, taken into consideration. Therefore, the properties of the steel sheet have been inferior (a hole expansion ratio d/d0 is 1.46 to 1.68, namely 46 to 68% in terms of a net hole expansion rate, when a tensile strength is 60 to 69 kgf/mm$^2$) and the application has been limited.

In the meantime, Japanese Unexamined Patent Publication No. H3-180426 discloses a bainite sheet steel excellent in the balance between strength and hole expandability (a hole expansion ratio d/d0 is 1.72 to 2.02, namely 72 to 102% in terms of a net hole expansion rate, when a tensile strength is 60 to 67 kgf/mm$^2$). However, since this technology provides not a multi-phase structure but the equalization of a structure (a bainite single phase structure), as a means of improving the net hole expansion rate, the balance between strength and elongation is rather insufficient (a total elongation is 27 to 30% when a tensile strength is 60 to 67 kgf/mm$^2$) and the application is again limited.

That is, though, in the press forming of auto parts, punch stretch formability represented by the balance between strength and elongation and stretch flange formability represented by the balance between strength and hole expandability are two major components of forming, such a technology, satisfying both the components simultaneously, has not been available and the excellence in both has been the key to the expansion of the application.

In recent years while the shift to high strength steel sheets is progressing at an increasing rate due to global environmental issues, as their application to components with high degree of forming difficulty has been taken into consideration, a steel sheet excellent in both the balance between strength and elongation and the balance between strength and hole expandability, in other words, a multi-phase steel sheet excellent in the balance between strength and hole expandability, has been demanded.

DISCLOSURE OF THE INVENTION

The object of the present invention is, by solving the problems of the conventional steel sheets, to provide a steel sheet having both the excellent balance between strength and hole expandability (not less than 35,000 MPa %, preferably not less than 46,000 MPa %, in terms of the value obtained by multiplying a tensile strength by a net hole expansion rate) and the excellent balance between strength and elongation (not less than 18,500 MPa %, preferably not less than 20,000 MPa %, in terms of the value obtained by multiplying a tensile strength by a total elongation), that is, a multi-phase steel sheet excellent in hole expandability, and a method of producing the same.

Both of the balance between strength and hole expandability (MPa·%), and the balance between strength and elongation (MPa·%) are indexes of press-formability. If these values are large, the resultant products exhibit excellent properties. The balance between strength and hole expandability is represented by the product of the value of strength (MPa) obtained by tensile test and the value of hole expansion ratio (%) obtained by hole expansion test. Further, the balance between strength and elongation is represented by the product of the value strength (MPa) obtained by tensile test and the value of total elongation obtained by tensile test. In the steel sheet which is generally used, if tensile strength increases, both of hole expansion ratio and elongation decrease and, as a result, both of the balance between strength and hole expandability (MPa·%), and the balance between strength and elongation (MPa·%) exhibit low values. On the other hand, according to the present invention, lowering the value both of hole expansion ratio and elongation can be restrained and it is possible to obtain the high values of the balance between strength and hole expandability (MPa·%), and the balance between strength and elongation (MPa·%).

The present inventors have earnestly studied, from the viewpoint of integrated manufacturing from steelmaking to hot rolling, and have finally invented a multi-phase steel sheet excellent in hole expandability and a method of producing the same.

The gist of the present inventions is as follows:

(1) A multi-phase steel sheet excellent in hole expandability characterized in that:

the steel sheet contains, as chemical components in mass,

C: 0.03 to 0.15%,

P: not more than 0.010%,

S: not more than 0.003%, and either one or both of Si and Al in a total amount of 0.5 to 4%, and one or more of Mn, Ni, Cr, Mo and Cu in a total amount of 0.5 to 4%, with the balance consisting of Fe and unavoidable impurities;

the microstructure at a section of the steel sheet is composed of either one or both of retained austenite and martensite which account(s) for 3 to 30% in total in area percentage and the balance consisting of either one or both of ferrite and bainite;

the maximum length of the crystal grains in the microstructure is not more than 10 microns; and the number of inclusions 20 microns or larger in size at a section of the steel sheet is not more than 0.3 pieces per square millimeter.

(2) A multi-phase steel sheet excellent in hole expandability characterized in that:

the steel sheet contains, as chemical components in mass,

C: 0.03 to 0.15%,

P: not more than 0.010%,

S: not more than 0.003%, and either one or both of Si and Al in a total amount of 0.5 to 4%, and one or more of Mn, Ni, Cr, Mo and Cu in a total amount of 0.5 to 4%, with the balance consisting of Fe and unavoidable impurities;

the microstructure at a section of the steel sheet is composed of either one or both of retained austenite and martensite which account(s) for 3 to 30% in total in area percentage, pearlite which accounts for more than 0% to not more than 3% in area percentage, and the balance consisting of either one or both of ferrite and bainite;

the maximum length of the crystal grains in the microstructure is not more than 10 microns; and the number of inclusions 20 microns or larger in size at a section of the steel sheet is not more than 0.3 pieces per square millimeter.

(3) A multi-phase steel sheet excellent in hole expandability according to the item (1) or (2), characterized in that the micro Vickers hardness of bainite is less than 240.

(4) A multi-phase steel sheet excellent in hole expandability according to any one of the items (1) to (3), characterized by further containing, as chemical components in mass, one or more of Nb, V and Ti in a total amount of 0.3% or less.

(5) A multi-phase steel sheet excellent in hole expandability according to any one of the items (1) to (4), characterized by further containing, as a chemical component in mass, B of 0.01% or less.

(6) A multi-phase steel sheet excellent in hole expandability according to any one of the items (1) to (5), characterized by further containing, as chemical components in mass, either one or both of Ca of 0.01% or less and REM of 0.05% or less.

(7) A method of producing a multi-phase steel sheet excellent in hole expandability, which steel sheet contains, as chemical components in mass, C: 0.03 to 0.15%, P: not more than 0.010%, S: not more than 0.003%, and either one or both of Si and Al in a total amount of 0.5 to 4%, and one or more of Mn, Ni, Cr, Mo and Cu in a total amount of 0.5 to 4%, with the balance consisting of Fe and unavoidable impurities, characterized by:

when molten steel with said components is refined, circulating the molten steel not less than 1.5 times after flux for desulfurization is added at the time of the desulfurization of the molten steel;

further, when a steel sheet is produced by hot-rolling a slab obtained by casting said molten steel, conducting the finish rolling by controlling the finish-rolling entry temperature to 950° C. or higher and the finish-rolling exit temperature within the range from 780 to 920° C.; and coiling the steel sheet thus obtained at a temperature of 500° C. or lower.

(8) A method of producing a multi-phase steel sheet excellent in hole expandability according to the item (7), characterized in that the steel sheet further contains, as chemical components in mass, one or more of Nb, V and Ti in a total amount of 0.3% or less.

(9) A method of producing a multi-phase steel sheet excellent in hole expandability according to the item (7) or (8), characterized in that the steel sheet further contains, as a chemical component in mass, B of 0.01% or less.

(10) A method of producing a multi-phase steel sheet excellent in hole expandability according to any one of the items (7) to (9), characterized in that the steel sheet further contains, as chemical components in mass, either one or both of Ca of 0.01% or less and REM of 0.05% or less.

BEST MODE FOR CARRYING OUT THE INVENTION

The present invention is explained in detail hereunder.

First, the chemical components are explained.

C is an important element for stabilizing austenite and obtaining a multi-phase structure, and C is added at not less than 0.03 mass % in order to stabilize austenite and to obtain either one or both of retained austenite and martensite in the total amount of not less than 3% in area percentage. However, the upper limit of C content is set at not more than 0.15 mass %, preferably not more than 0.11 mass %, in order to avoid the deterioration of weldability and an adverse influence on a net hole expansion rate.

Figure 1:
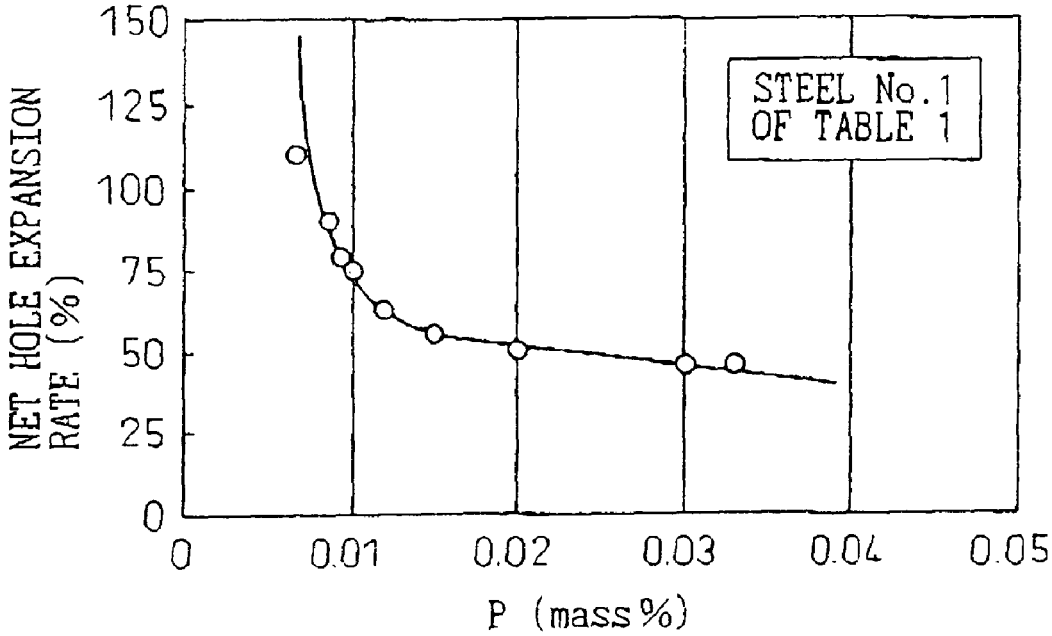
FIG. 1 is a graph showing the effect of the chemical component P on a net hole expansion rate.

P is a key element among the addition elements of the present invention. The effect of P is demonstrated in FIG. 1. FIG. 1 shows the result of the investigation on the relationship between the P content and the net hole expansion rate of a steel sheet, using the steel sheets having the chemical components of Steel No. 1 in Table 1.

TABLE 1

| Steel | Chemical components (mass %) | | | | | | | |
|---|---|---|---|---|---|---|---|---|
| No. | C | Si | Mn | P | S | Al | N | Al + Si |
| 1 | 0.11 | 1.88 | 1.40 | 0.006-0.034 | 0.001 | 0.03 | 0.003 | 1.41 |
| 2 | 0.10 | 1.40 | 1.40 | 0.008 | 0.001 | 0.04 | 0.002 | 1.44 |

A net hole expansion rate is calculated based on the Japan Iron and Steel Federation Standard JFS T 1001-1996. From FIG. 1, the net hole expansion rate improves remarkably and exponentially by controlling the P content to not more than 0.010 mass % and its effect on the net hole expansion rate, which has not yet been assumed within the range of conventional concepts, is recognized. By so doing, press cracking can be avoided. Although the reason is not completely clear, it is supposed that the reduction of P content improves the properties of the edge of a punched hole (for instance: the minimization of facet size, the reduction of roughness and the reduction of microcracks on a fractured plane; the suppression of the deterioration of workability in a microstructure on a sheared plane; and the like), and leads to the improvement of a net hole expansion rate.

S content is set at not more than 0.003 mass %, preferably not more than 0.001 mass %, from the viewpoint of preventing the deterioration of a net hole expansion rate and weldability caused by sulfide-system inclusions.

Si and Al are elements useful for obtaining a multi-phase structure. They make either one or both of retained austenite and martensite account for not less than 3% in total in area percentage and have the function of improving a net hole expansion rate, by promoting the formation of ferrite and suppressing the formation of carbide, and further by strengthening ferrite, thus reducing the hardness difference between ferrite and hard phases (such as bainite and martensite) and contributing to the uniformity of a structure. Moreover, they act also as deoxidizing elements. From the above-mentioned viewpoint, the lower limit of the total addition amount of either one or both of Si and Al should be not less than 0.5 mass %. Considering the balance between the cost and the effect, the upper limit of the total addition amount is set at not more than 4 mass %.

With regard to the addition amount of each of Si and Al, the following may be taken into consideration.

When excellent surface quality is required in particular, either one of the means of avoiding Si scale by controlling the Si content to less than 0.1 mass %, preferably not more than 0.01 mass %, and the means of making Si scale harmless (making scale less conspicuous by forming the scale all over the surface) by controlling the Si content rather to more than 1.0 mass %, preferably more than 1.2 mass %, may be adopted.

It is also possible to increase the addition amount of Al and reduce the addition amount of Si to meet the requirement of material properties, for example, in a case where it is desired to lower a tensile strength by making use of the difference between Si and Al in the function of strengthening ferrite.

Al may be limited to not more than 0.2 mass %, preferably not more than 0.1 mass %, considering the drawbacks in steelmaking, such as the erosion of refractory materials, nozzle clogging and the like, and the material properties.

Mn, Ni, Cr, Mo, and Cu are elements useful for obtaining a multi-phase structure, and also are elements which strengthen ferrite. From the above-mentioned viewpoint, the lower limit of the total addition amount of one or more of them should be not less than 0.5 mass %. However, considering the balance between the cost and the effect, the upper limit of the total addition amount is set at not more than 4 mass %.

Furthermore, one or more of Nb, V, Ti, B, Ca and REM may be added as selective elements.

Nb, V and Ti are elements effective for a higher strength. However, considering the balance between the cost and the effect, the total addition amount of one or more of those elements is set at not more than 0.3 mass %.

B has a function as a strengthening element, and may be added by not more than 0.01 mass %. In addition, B also has the effect of mitigating the adverse effect of P.

Ca may be added by not more than 0.01 mass % since Ca further improves a net hole expansion rate by controlling the shape of sulfide-system inclusions (spheroidizing).

Moreover, REM may also be added by not more than 0.05 mass % for the same reason.

In addition, N may be added by not more than 0.02 mass %, if required, aiming at the stabilization of austenite and the strengthening of a steel sheet.

Next, a microstructure is explained hereunder.

In order to obtain an excellent net hole expansion rate, from the viewpoint of not deteriorating the uniformity of a fractured surface size, one of the properties of the edge of a punched hole, and the like, which uniformity has been improved by the ultimate reduction of P, the control of the maximum length of crystal grains in a microstructure and the control of the amount and size of inclusions are especially important. Therefore, that is explained first.

As the crystal grain size of a microstructure affects the fractured surface size at the edge of a punched hole, it affects a net hole expansion rate remarkably. Even in the case where the average size of crystal grains in a microstructure is fine, if the maximum grain size is large, it adversely affects a net hole expansion rate. As a microstructure is composed of many crystal grains, a net hole expansion rate cannot be governed by the average grain size: when a big crystal grain exists among many crystal grains, it adversely affects the net hole expansion rate even if the average grain size is fine. Here, with regard to the size of a crystal grain, not a circle-reduced diameter but the maximum length thereof affects a net hole expansion rate.

Figure 2:
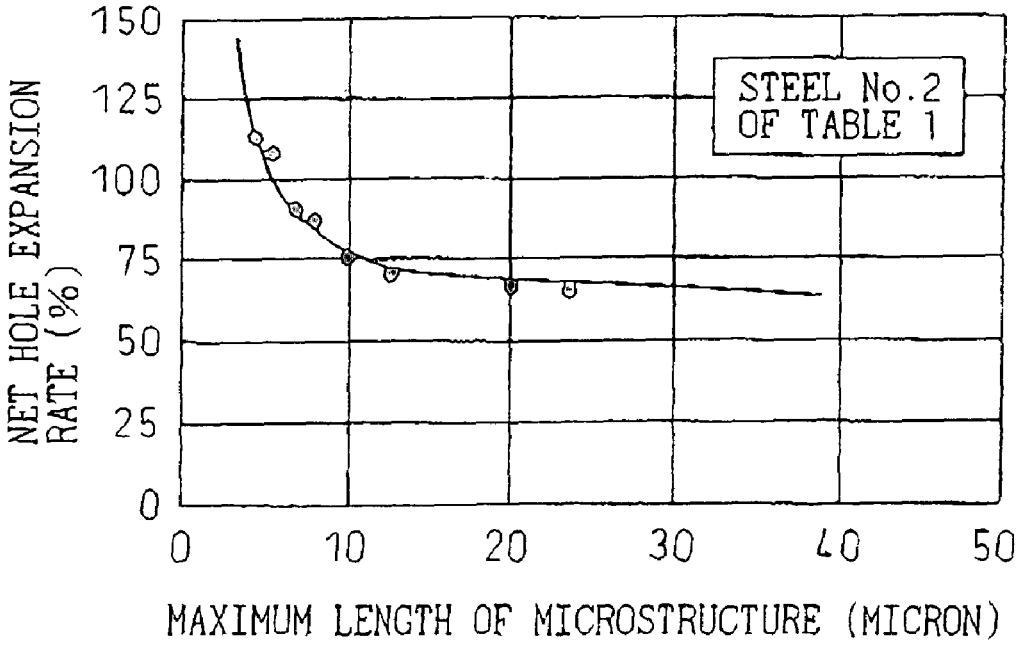
FIG. 2 is a graph showing the effect of the maximum length of a microstructure on a net hole expansion rate.

FIG. 2 shows the result of the investigation on the relationship between the maximum length of a microstructure in a steel sheet and the net hole expansion rate of the steel sheet, using the steel sheets having the chemical components of Steel No. 2 in Table 1. As shown in FIG. 2, the net hole expansion rate improves remarkably and exponentially when the maximum length of a microstructure is not larger than 10 microns, and its effect on the net hole expansion rate, which has not yet been assumed within the range of the conventional concept, is recognized. By so doing, press cracking can be avoided.

Here, the maximum length of a microstructure was calculated from an optical micrograph under the magnification of 400 taken at a section perpendicular to the rolling direction of a steel sheet after the section was etched with a nitral reagent and the reagent disclosed in Japanese Unexamined Patent Publication No. S59-219473, averaging all over the section along the thickness direction.

Figure 3:
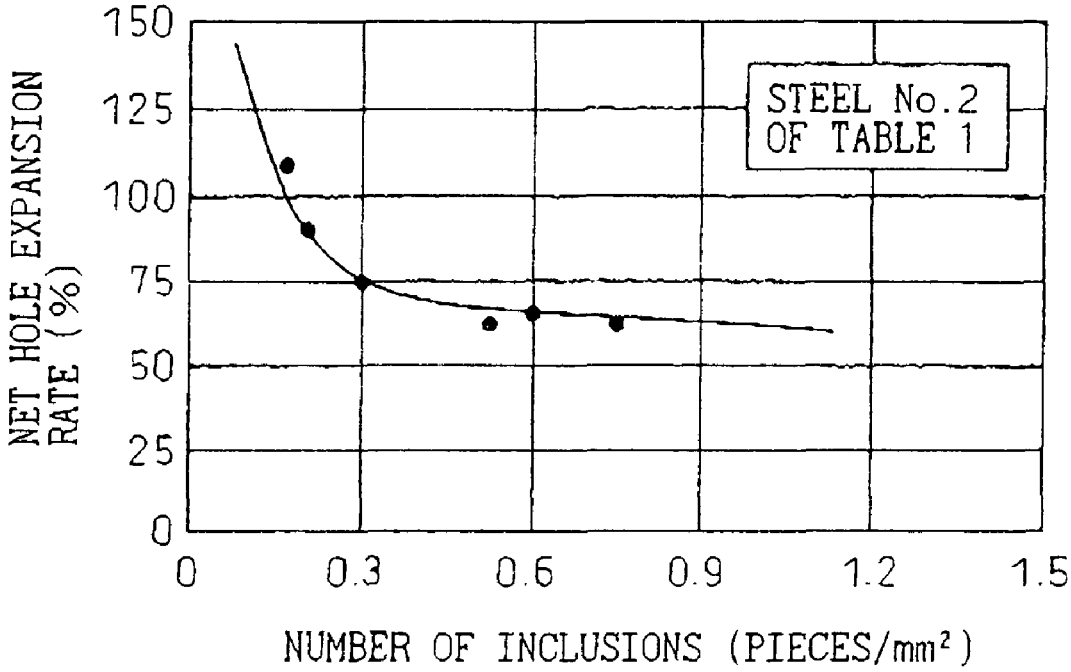
FIG. 3 is a graph showing the effect of the number of inclusions on a net hole expansion rate.

Moreover, with regard to inclusion control, a net hole expansion rate can be improved by reducing the number of coarse inclusions. The number of coarse inclusions was obtained by observing a polish-finished section along the rolling direction of a steel sheet with a microscope (400 magnifications) and integrating the number of coarse inclusions 20 microns or larger in maximum length. FIG. 3 shows the result of the investigation on the relationship between the number of coarse inclusions (20 microns or larger in maximum length) in a steel sheet and the net hole expansion rate, using the steel sheets having the chemical components of Steel No. 2 in Table 1. It is understood that, when the number of coarse inclusions (20 microns or larger in maximum length) is not more than a specified number (not more than 0.3 piece per square millimeter), the net hole expansion rate can be improved remarkably and press cracking can be avoided.

In addition, controlling the micro Vickers hardness of bainite to less than 240 acts preferably on the improvement of hole expandability. The reduction of the hardness of bainite lowers the hardness difference between ferrite and bainite and thus contributes to the improvement of the uniformity of a structure. However, if the micro Vickers hardness of bainite exceeds 240, the hardness difference between ferrite and bainite deviates from the range desirable for hole expandability and further the deterioration of hole expandability is caused by the deterioration of workability of the bainite itself. The reduction of P (not more than 0.01%) largely contributes to enhancing the effect, but details are not known.

Here, the micro Vickers hardness of bainite is obtained by identifying bainite by etching a section perpendicular to the rolling direction of a steel sheet with the reagent disclosed in Japanese Unexamined Patent Publication No. S59-219473, and by averaging the values measured at five points (averaging the values excluding the maximum and minimum values from among the values measured at seven points) under a load of 1 to 10 gr.

Furthermore, in order to obtain an excellent balance between strength and elongation as well as an excellent balance between strength and hole expandability, it is essential to control the kind and the area percentage of a multi-phase structure.

An excellent balance between strength and elongation (not less than 18,500 MPa % in terms of the value obtained by multiplying a tensile strength by a total elongation) and an excellent balance between strength and hole expandability (not less than 35,000 MPa % in terms of the value obtained by multiplying a tensile strength by a net hole expansion rate) are obtained by controlling the total area percentage of either one or both of retained austenite and martensite to 3 to 30%.

When the total area percentage of either one or both of retained austenite and martensite is less than 3%, it becomes impossible to obtain the stable effect of improving the balance between strength and elongation, which is to be obtained by the retained austenite and martensite. Therefore, its lower limit is set at 3%.

When the total area percentage of either one or both of retained austenite and martensite is more than 30%, the effect of improving the balance between strength and elongation is saturated and the deterioration of a net hole expansion rate and the like are caused. Therefore, from the viewpoint of press formability, the upper limit of the total area percentage is set at 30%.

Here, it is preferable that pearlite is not contained in a steel sheet since it hinders a balance between strength and elongation and a balance between strength and hole expandability. Therefore, the area percentage of pearlite is determined to be not more than 3% at most, preferably not more than 1%.

It is more desirable to add the following restrictions in addition to the above restrictions.

When a particularly excellent balance between strength and elongation (not less than 20,000 MPa %) is required, it is desirable that the area percentage of retained austenite is set at not less than 3%.

Moreover, when a particularly excellent balance between strength and hole expandability (not less than 46,000 MPa % in terms of the value obtained by multiplying a tensile strength by a net hole expansion rate) is required, it is desirable that the area percentage of martensite is set at not more than 3%.

On the other hand, when a low yield ratio (not more than 70% in terms of yield ratio YR which is a value obtained by dividing a yield stress by a tensile strength and then multiplying the divided value by 100) is required from the viewpoint of the shape fixability, the area percentage of martensite is set at not less than 3%.

Preferably, by controlling the maximum length of the microstructure of retained austenite and/or martensite to not more than 2 microns, the effect increases yet further.

The remainder structure of a microstructure consists of either one or both of ferrite and bainite, and by controlling the total area percentage of ferrite and bainite to not less than 80%, the deterioration of press formability, which is caused by hard structures other than ferrite and bainite combining with each other in the form of a network, can be suppressed.

Due to the effect described above, both an excellent balance between strength and hole expandability (not less than 35,000 MPa %, preferably not less than 46,000 MPa %, in terms of the value obtained by multiplying a tensile strength by a net hole expansion rate) and an excellent balance between strength and elongation (not less than 18,500 MPa %, preferably not less than 20,000 MPa %, in terms of the value obtained by multiplying a tensile strength by a total elongation) can be obtained simultaneously, and press formability improves markedly.

Here, the identification of the constitution of a microstructure, the measurement of an area percentage, and the measurement of the maximum length of retained austenite and/or martensite were carried out with an optical micrograph under the magnification of 1,000 taken at a section perpendicular to the rolling direction of a steel sheet after the section was etched with a nitral reagent and the reagent disclosed in Japanese Unexamined Patent Publication No. S59-219473, and by X-ray analysis.

Next, the production method is explained hereunder.

Firstly, when molten steel is refined in a steelmaking process, it is important to let the molten steel reflux not less than 1.5 times after the addition of flux for desulfurization at the time when the molten steel is desulfurized using a secondary refining apparatus such as an RH. Here, the reflux of molten steel is represented by the amount of molten steel that circulates the inside of a secondary refining apparatus, such as an RH, per unit time, and there are various formulas for the computation. For example, as disclosed in "The Refining Limitation of Impurity Elements in a Mass Production Scale" (Iron and Steel Institute of Japan, the Forum of Elevated Temperature Refining Process Section, and Japan Society for the Promotion of Science, the 19th Steelmaking Committee, Reaction Process Workshop, March 1996, P. 184-187), the amount of refluxed molten steel Q expressed by the following Equation 1 is defined as the refluxed amount of one time:

$$\text{Refluxed amount } Q = 11.4 \times V^{1/3} \times D^{4/3} \times \{\ln(P1/P0)\}^{1/3} \times k \qquad \text{Eq 1}$$

where

Q: Amount of refluxed molten steel (t/min.),

V: Flow rate of refluxed gas (Nl/min.),

D: Inner diameter of snorkel (m),

P0: Pressure in vacuum chamber (Pa),

P1: Pressure at injection port of refluxed gas (Pa), and k: Constant (a constant determined based on secondary refinement apparatus, 4 in this case).

Figure 4:
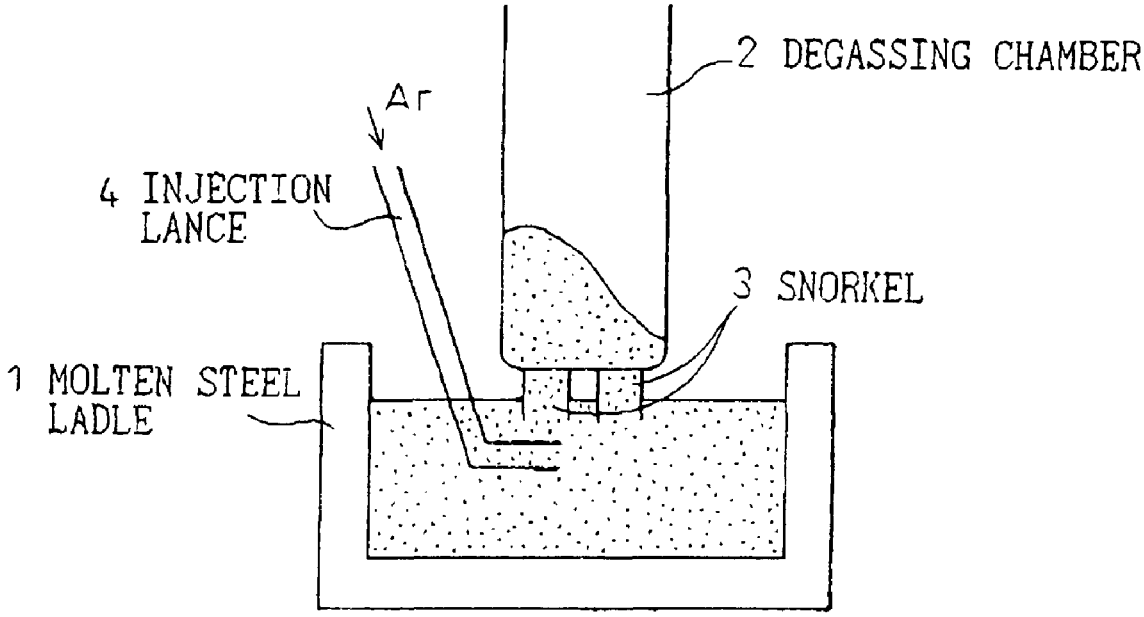
FIG. 4 is a schematic drawing showing the refining of molten steel when an RH is used.

The schematic drawing of the refining of molten steel using an RH is shown in FIG. 4. Two snorkels 3 of the degassing chamber 2 are dipped into the molten steel ladle 1, gas is blown from underneath one of these snorkels (in this case, Ar is blown from underneath one of the snorkels through the injection lance 4), then, the molten steel in the molten steel ladle 1 rises and enters the degassing chamber 2, and after the degassing process, the molten steel descends and returns from the other snorkel 3 to the molten-steel ladle. Here, though the example wherein a secondary refining apparatus employing an RH is used is shown, it is needless to say that other apparatus (for example, a DH) may be used.

Figure 5:
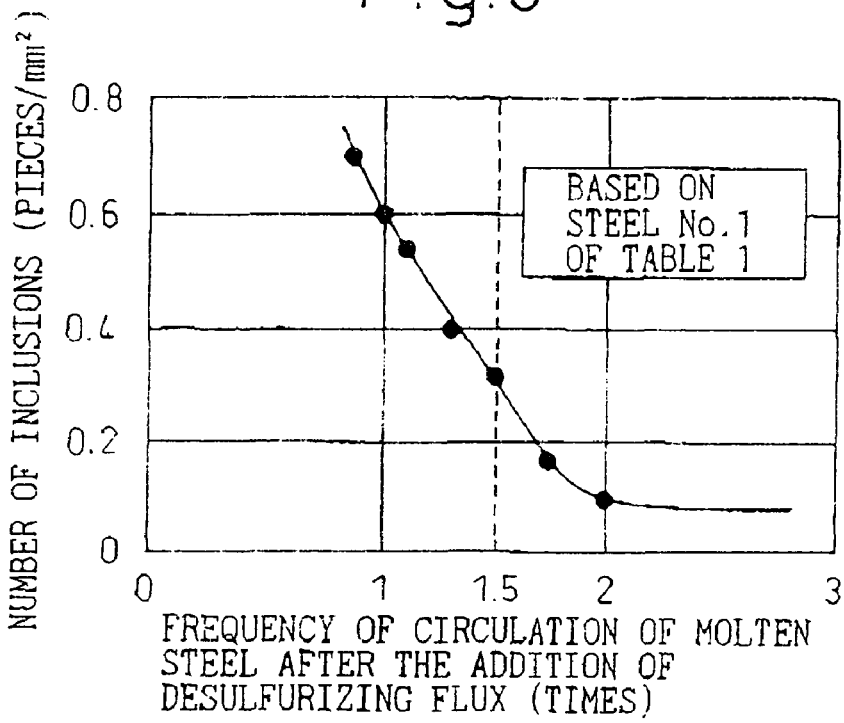
FIG. 5 is a graph showing the effect of the frequency of the reflux of molten steel after flux addition for desulfurization on the number of inclusions.

FIG. 5 shows the result of investigating the relationship between the frequency of the reflux of molten steel after flux for desulfurization is added when molten steel having the components of Steel No. 2 in Table 1 is refined and the number of inclusions 20 microns or larger in size per square mm at a section of a steel sheet obtained by hot-rolling a slab cast from the molten steel. As shown in FIG. 5, by increasing the frequency of the reflux of molten steel, the surfacing of the desulfurization flux system inclusions is notably promoted, the number of coarse inclusions (20 microns or larger) can be reduced to not more than a prescribed number (not more than 0.3 per square mm), the net hole expansion rate is improved, and thus press cracking is avoided.

Figure 6:
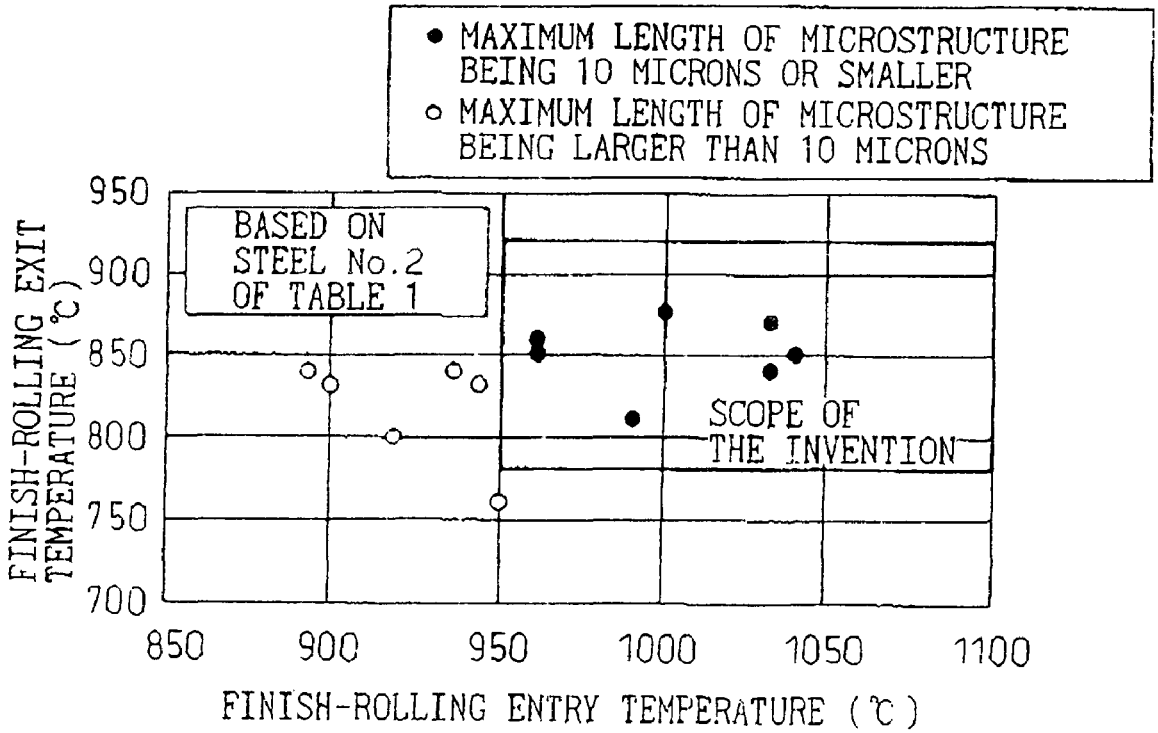
FIG. 6 is a graph showing the effect of finish-rolling entry and exit temperatures the finishing mill in hot rolling on the maximum length of a microstructure.

Next, the condition of the temperature at finish rolling in a hot-rolling process when a hot-rolled steel sheet according to the present invention is produced is examined. FIG. 6 shows the result of summarizing the relation among finish-rolling entry and exit temperatures when a slab having the components of Steel No. 2 in Table 1 is hot-rolled, and the maximum length of crystal grains in the microstructure at a section of the steel sheet obtained.

As shown in FIG. 6, by regulating the finish-rolling entry temperature at not lower than 960° C. and the finish-rolling exit temperature at not lower than 780° C., the maximum length of the microstructure is certainly controlled to not larger than 10 microns and, therefore, a net hole expansion rate can be improved and press cracking can be avoided. Preferably, it is desirable to regulate the finish-rolling entry temperature in accordance with chemical components, finish-rolling speed and finish-rolling exit temperature.

Here, if a finish-rolling exit temperature exceeds 920° C., the whole microstructure coarsens, the drawbacks such as the deterioration of press formability and the generation of scale defects remarkably appear, and therefore the temperature is determined to be the upper limit.

Though conditions on a cooling table after finish rolling are not particularly specified, the multi-step control of a cooling rate (the combination of quenching, slow cooling and isothermal retention) or immediate quenching at the finish-rolling exit, which are generally known, may be employed, aiming at the control of the area percentage of a microstructure and the promotion of the fining of a microstructure and the formation of a multi-phase structure.

The upper limit of a coiling temperature is set at 500° C. in order for either one or both of retained austenite and martensite to account for 3% or more in total in area percentage. If a coiling temperature exceeds 500° C., the total area percentage of 3% or more cannot be secured and thus an excellent balance between strength and elongation (tensile strength multiplied by total elongation) is not obtained.

Here, either air cooling or forced cooling may be employed for the cooling of a steel sheet after it is coiled.

In addition, a slab may be subjected to rolling after once being cooled and then reheated, or rolling by HCR or HDR. Further, a slab may be produced by so-called thin slab continuous casting.

Furthermore, a steel sheet according to the present invention may be plated with Zn or the like for improving corrosion resistance, or may be coated with a lubricant or the like for further improving press formability.

EXAMPLE

The chemical compositions other than Fe of the steels subjected to the test are shown in Table 2.

The production conditions in the steelmaking and hot rolling of the steels subjected to she test are shown in Table 3. The microstructures and material properties of hot-rolled steel sheets obtained are shown in Tables 4 and 5.

TABLE 2

| Steel | Chemical components (mass %) | | | | | | | | | | | | | | |
|---|---|---|---|---|---|---|---|---|---|---|---|---|---|---|---|
| No. | C | Si | Mn | P | S | Al | N | Ni | Cr | Cu | Mo | Others | *1 | *2 | Remarks |
| 1 | 0.11 | 1.38 | 1.40 | 0.009 | 0.001 | 0.03 | 0.003 | — | — | — | — | | 1.41 | 1.40 | |
| 2 | 0.10 | 1.40 | 1.40 | 0.008 | 0.001 | 0.04 | 0.002 | — | — | — | — | Ca: 0.0035 | 1.44 | 1.40 | |
| 3 | 0.09 | 1.35 | 1.36 | 0.010 | 0.001 | 0.04 | 0.002 | — | — | — | — | B: 0.001 | 1.39 | 1.36 | |
| 4 | 0.11 | 1.42 | 1.39 | 0.009 | 0.002 | 0.02 | 0.003 | — | — | — | — | V: 0.0011 | 1.44 | 1.39 | |
| 5 | 0.06 | 1.55 | 1.50 | 0.008 | 0.001 | 0.10 | 0.002 | — | — | — | — | Ti: 0.014 | 1.65 | 1.50 | |
| 6 | 0.06 | 1.51 | 1.53 | 0.006 | 0.001 | 0.03 | 0.002 | — | — | — | — | Nb: 0.012, REM: 0.0015 | 1.54 | 1.63 | |
| 7 | 0.08 | 1.50 | 1.45 | 0.006 | 0.001 | 0.04 | 0.004 | — | — | — | 0.10 | | 1.54 | 1.55 | |
| 8 | 0.08 | 1.49 | 1.54 | 0.015 | 0.002 | 0.03 | 0.004 | — | — | 0.15 | — | | 1.52 | 1.69 | P being outside range of present invention |
| 9 | 0.14 | 1.39 | 1.26 | 0.009 | 0.001 | 0.03 | 0.003 | — | 0.16 | — | — | | 1.42 | 1.42 | |
| 10 | 0.13 | 1.40 | 1.20 | 0.008 | 0.001 | 0.03 | 0.004 | 0.14 | — | — | — | | 1.43 | 1.43 | |
| 11 | 0.06 | 1.25 | 1.29 | 0.008 | 0.001 | 0.03 | 0.003 | — | — | — | — | | 1.28 | 1.39 | |
| 12 | 0.06 | 1.21 | 1.35 | 0.015 | 0.001 | 0.02 | 0.003 | — | — | — | — | | 1.23 | 1.35 | P being outside range of present invention |
| 13 | 0.07 | 1.22 | 1.32 | 0.010 | 0.002 | 0.03 | 0.003 | — | — | 0.12 | — | | 1.25 | 1.44 | |
| 14 | 0.09 | 1.10 | 1.30 | 0.009 | 0.001 | 0.03 | 0.004 | — | 0.08 | — | — | | 1.13 | 1.38 | |
| 15 | 0.08 | 1.05 | 1.30 | 0.006 | 0.002 | 0.02 | 0.002 | 0.12 | — | — | — | | 1.07 | 1.42 | |
| 16 | 0.11 | 1.98 | 1.95 | 0.009 | 0.001 | 0.03 | 0.003 | — | — | — | — | | 2.01 | 1.95 | |
| 17 | 0.14 | 1.45 | 1.05 | 0.005 | 0.001 | 0.02 | 0.003 | — | — | — | — | | 1.47 | 1.05 | |

*1 Al + Si (not including unavoidable impurities)

*2 Mn + Ni + Cr + Cu + Mo (not including unavoidable impurities)

TABLE 3

| | | Steelmaking conditions | | Hot-rolling conditions | | |
|---|---|---|---|---|---|---|
| No. | Steel No. | Frequency of circulation of molten steel, t (time) *1 | Slab size, thickness × width (mm) | Finish-rolling entry temperature, FT0 (° C.) | Finish-rolling exit temperature, FT7 (° C.) | Size after finish rolling, thickness × width (mm) |
| 1 | 1 | 1.7 | 250 × 950 | 960 | 855 | 3.2 × 850 |
| 2 | 1 | 3.5 | 250 × 950 | 1010 | 865 | 3.2 × 850 |
| 3 | 1 | 2.5 | 250 × 950 | 935 | 825 | 3.2 × 850 |
| 4 | 1 | 0.9 | 250 × 950 | 990 | 850 | 3.2 × 850 |
| 5 | 1 | 0.6 | 250 × 950 | 1040 | 895 | 3.2 × 850 |
| 6 | 2 | 1.5 | 250 × 1100 | 1035 | 875 | 3.2 × 850 |
| 7 | 3 | 1.6 | 250 × 1400 | 915 | 810 | 3.2 × 850 |
| 8 | 4 | 2.0 | 250 × 850 | 1020 | 860 | 3.2 × 850 |
| 9 | 5 | 1.7 | 245 × 1100 | 1025 | 865 | 2.9 × 920 |
| 10 | 6 | 1.6 | 245 × 1100 | 1000 | 855 | 2.9 × 920 |
| 11 | 7 | 0.7 | 250 × 1000 | 980 | 850 | 2.6 × 1000 |
| 12 | 8 | 2.4 | 250 × 1000 | 1020 | 870 | 2.6 × 1000 |
| 13 | 9 | 2.3 | 250 × 1000 | 945 | 835 | 3.0 × 990 |
| 14 | 10 | 1.7 | 250 × 950 | 985 | 856 | 3.0 × 990 |
| 15 | 11 | 2.6 | 250 × 950 | 990 | 860 | 9.2 × 1250 |
| 16 | 12 | 1.5 | 245 × 900 | 1010 | 890 | 3.2 × 1350 |
| 17 | 13 | 0.8 | 245 × 850 | 995 | 860 | 2.9 × 1215 |
| 18 | 14 | 1.8 | 235 × 1000 | 920 | 820 | 3.5 × 1350 |
| 19 | 15 | 1.2 | 235 × 950 | 1025 | 880 | 3.5 × 900 |
| 20 | 16 | 1.7 | 260 × 950 | 1000 | 855 | 9.2 × 850 |
| 21 | 17 | 1.7 | 260 × 950 | 960 | 855 | 9.2 × 850 |
| 22 | 17 | 1.7 | 250 × 950 | 960 | 930 | 3.2 × 850 |

| No. | Steel No. | Cooling conditions on cooling table | Coiling conditions Coiling temperature, CT (° C.) | Remarks |
|---|---|---|---|---|
| 1 | 1 | 50° C./sec. | 415 | |
| 2 | 1 | 50° C./sec. | 475 | |
| 3 | 1 | 50° C./sec. | 400 | FT0 being outside range of present invention |
| 4 | 1 | 50-15-50° C./sec. | 405 | t being outside range of present invention |
| 5 | 1 | 50° C./sec. | 400 | t being outside range of present invention |
| 6 | 2 | 50° C./sec. | 870 | |
| 7 | 3 | 50° C./sec | 410 | FT0 being outside range of present invention |
| 8 | 4 | 50° C./sec. | 405 | |
| 9 | 5 | 55° C./sec. | 505 | CT being outside range of present invention |
| 10 | 6 | 55° C./sec. | 440 | |
| 11 | 7 | 60° C./sec | 415 | t being outside range of present invention |
| 12 | 8 | 60° C./sec. | 360 | |
| 13 | 9 | 55° C./sec. | 395 | FT0 being outside range of present invention |
| 14 | 10 | 55° C./sec. | 410 | |
| 15 | 11 | 50° C./sec. after air cooling for 5 sec. | <100 | |
| 16 | 12 | 50-15-50° C./sec. | <100 | |
| 17 | 13 | 50° C./sec. after air cooling for 5 sec. | <100 | t being outside range of present invention |
| 18 | 14 | 50° C./sec. after air cooling for 5 sec. | <100 | FT0 being outside range of present invention |
| 19 | 15 | 50° C./sec. after air cooling for 5 sec. | <100 | t being outside range of present invention |
| 20 | 16 | 50° C./sec. | 400 | |
| 21 | 17 | 50° C./sec. | 600 | CT being outside range of present invention |
| 22 | 17 | 50-15-50° C./sec. | <100 | FT7 being outside range of present invention |

*1 The frequency of the reflux of molten steel can be calculated by, for example, the following equation. The amount of refluxed molten steel Q expressed by the following equation is defined as the refluxed amount of one time: Refluxed amount $Q = [11.4 \times V^{1/3} \times D^{4/3} \times \{\ln(P1/P0)\}^{1/3}] \times 4$, where V: Flow rate of refluxed gas (Nl/min.), D: Sectional area of snorkel ($m^2$), P0: Pressure in vacuum chamber (Pa), and P1: Pressure at injection port of refluxed gas (Pa).

TABLE 4

| No. | F Area percentage (%) | B Area percentage (%) | F + B Area percentage (%) | Retained γ Area percentage (%) | M Area percentage | Retained γ + M Area percentage (%) | Retained γ + M Average grain size (micron) | Remainder microstructure |
|---|---|---|---|---|---|---|---|---|
| 1 | 84 | 11 | 95 | 5 | 0 | 5 | 2 | |
| 2 | 85 | 11 | 96 | 3 | 0 | 3 | 2 | 1% P |
| 3 | 83 | 9 | 92 | 8 | 0 | 8 | 2 | |
| 4 | 85 | 10 | 95 | 5 | 0 | 5 | 2 | |
| 5 | 86 | 11 | 97 | 3 | 0 | 3 | 3 | |
| 6 | 84 | 10 | 94 | 6 | 0 | 6 | 2 | |
| 7 | 83 | 11 | 94 | 6 | 0 | 6 | 2 | |
| 8 | 85 | 11 | 96 | 4 | 0 | 4 | 2 | |
| 9 | 82 | 16 | 98 | 1 | 0 | 1 | 2 | 1% P |
| 10 | 83 | 13 | 96 | 4 | 0 | 4 | 3 | |
| 11 | 82 | 13 | 95 | 5 | 0 | 5 | 2 | |
| 12 | 60 | 13 | 93 | 3 | 4 | 7 | 2 | |
| 13 | 82 | 10 | 92 | 8 | 0 | 8 | 2 | |
| 14 | 82 | 11 | 93 | 7 | 0 | 7 | 2 | |
| 15 | 80 | 6 | 86 | 2 | 12 | 14 | 3 | |
| 16 | 80 | 4 | 84 | 3 | 13 | 16 | 3 | |
| 17 | 80 | 5 | 85 | 3 | 12 | 15 | 3 | |
| 18 | 82 | 6 | 88 | 0 | 12 | 12 | 3 | |
| 19 | 83 | 5 | 88 | 1 | 11 | 12 | 3 | |
| 20 | 65 | 30 | 95 | 5 | 0 | 5 | 2 | |
| 21 | 77 | 15 | 92 | 0 | 0 | 0 | — | 8% P |
| 22 | 69 | 0 | 69 | 0 | 31 | 31 | >10 | |

| No. | Maximum length of microstructure being 10 microns or smaller | Number of inclusions 20 microns or larger in size being 0.3 or less | Micro Vickers hardness of B being 240 or less | Remarks |
|---|---|---|---|---|
| 1 | ○ | ○ | ○ | |
| 2 | ○ | ○ | ○ | |
| 3 | x | ○ | x | Maximum length of microstructure being outside range of present invention |
| 4 | ○ | x | ○ | Number of inclusions being outside range of present invention |
| 5 | ○ | x | ○ | Number of inclusions being outside range of present invention |
| 6 | ○ | ○ | ○ | |
| 7 | x | ○ | x | Maximum length of microstructure being outside range of present invention |
| 8 | ○ | ○ | ○ | |
| 9 | ○ | ○ | ○ | γ + M being outside range of present invention |
| 10 | ○ | ○ | ○ | |
| 11 | ○ | x | ○ | Number of inclusions being outside range of present invention |
| 12 | ○ | ○ | x | |
| 13 | x | ○ | x | Maximum length of microstructure being outside range of present invention |
| 14 | ○ | ○ | ○ | |
| 15 | ○ | ○ | ○ | |
| 16 | ○ | ○ | x | |
| 17 | ○ | x | ○ | Number of inclusions being outside range of present invention |
| 18 | x | ○ | x | Maximum length of microstructure being outside range of present invention |
| 19 | ○ | x | ○ | Number of inclusions being outside range of present invention |
| 20 | ○ | ○ | ○ | |
| 21 | ○ | ○ | ○ | γ + M and P being outside range of present invention |

TABLE 4-continued

| | | | | |
|---|---|---|---|---|
| 22 | x | ○ | — | γ + M and maximum length being outside range of present invention |

Microstructure:
F; ferrite,
B; bainite,
retained γ; retained austenite,
M; martensite, and
P; pearlite

TABLE 5

| | Punching hole expandability | | Static tensile properties | | | | | |
|---|---|---|---|---|---|---|---|---|
| No. | Net hole expansion rate λ (%) | TS × λ MPa. % | TS MpA | YS MpA | T.El % | YR % | TS × TEl Mpa. % | Remarks |
| 1 | 80 | 48320 | 604 | 476 | 36 | 0.79 | 21744 | Invented example |
| 2 | 94 | 56870 | 605 | 495 | 34 | 0.82 | 20570 | Invented example |
| 3 | 57 | 34884 | 612 | 494 | 34 | 0.81 | 20808 | Comparative example |
| 4 | 56 | 34832 | 622 | 465 | 35 | 0.75 | 21770 | Comparative example |
| 5 | 53 | 32595 | 615 | 491 | 32 | 0.80 | 19680 | Comparative example |
| 6 | 98 | 60760 | 620 | 496 | 33 | 0.80 | 20460 | Invented example |
| 7 | 56 | 34664 | 619 | 477 | 35 | 0.77 | 21665 | Comparative example |
| 8 | 85 | 51340 | 604 | 480 | 34 | 0.79 | 20536 | Invented example |
| 9 | 112 | 67312 | 601 | 485 | 28 | 0.81 | 16828 | Comparative example |
| 10 | 104 | 62400 | 600 | 466 | 35 | 0.78 | 21000 | Invented example |
| 11 | 55 | 33385 | 607 | 471 | 34 | 0.78 | 20638 | Comparative example |
| 12 | 50 | 30950 | 619 | 490 | 32 | 0.79 | 19808 | Comparative example |
| 13 | 55 | 34375 | 625 | 468 | 35 | 0.75 | 21875 | Comparative example |
| 14 | 105 | 64890 | 618 | 472 | 34 | 0.76 | 21012 | Invented example |
| 15 | 75 | 46575 | 621 | 410 | 33 | 0.66 | 20493 | Invented example |
| 16 | 45 | 27810 | 618 | 399 | 32 | 0.65 | 19776 | Comparative example |
| 17 | 40 | 25160 | 629 | 411 | 31 | 0.65 | 19499 | Comparative example |
| 18 | 46 | 29440 | 640 | 421 | 29 | 0.66 | 18560 | Comparative example |
| 19 | 45 | 28530 | 634 | 409 | 31 | 0.65 | 19654 | Comparative example |
| 20 | 81 | 63261 | 781 | 560 | 29 | 0.72 | 22649 | Invented example |
| 21 | 70 | 42350 | 605 | 540 | 26 | 0.89 | 15780 | Comparative example |
| 22 | 30 | 23400 | 780 | 535 | 23 | 0.69 | 17940 | Comparative example |

Here, the evaluations of properties and microstructures were carried out by the following methods.

Tensile test was carried out with JIS No. 5 test pieces, and tensile strength (TS), yield strength (YS), yield ratio (YR=YS/TS×100), total elongation (T.EL), and the balance between strength and elongation (TS×T.EL) were obtained.

A net hole expansion rate was calculated based on the Japan Iron and Steel Federation Standard JFS T1001-1996.

The maximum length of crystal grains in a microstructure was calculated from an optical micrograph under the magnification of 400 taken at a section perpendicular to the rolling direction of a steel sheet after the section was etched with a nitral reagent and the reagent disclosed in Japanese unexamined Patent Publication No. S59-219473.

The number of coarse inclusions in a steel sheet was obtained by observing a polish-finished section perpendicular to the rolling direction of a steel sheet with a microscope (400 magnifications) and integrating the number of coarse inclusions 20 microns or larger in maximum length.

The identification of the constitution of a microstructure, the measurement of an area percentage, and the measurement of the maximum length of retained austenite and/or martensite were carried out with an optical micrograph under a magnification of 1,000× taken at a section perpendicular to the rolling direction of a steel sheet after the section was etched with a nitral reagent, the reagent disclosed in Japanese Unexamined Patent Publication No. S59-219473 and the reagent disclosed in Japanese Unexamined Patent Publication No. H5-163590, and with X-ray analysis.

An area percentage of retained austenite (Fγ: in %) was calculated according to the following equation based on Mo—Kα rays in X-ray analysis:

$$F\gamma(\%)=(2/3)\{100/(0.7\times\alpha(211)/\gamma(220)+l)\}+(1/3)\{100/(0.78\times\alpha(211)/\gamma(311)+1)\},$$

where, α(211), γ(220), α(211), and γ(311) represent the intensity on the respective planes.

In the examples of the present invention (Nos. 1, 2, 6, 8, 10, 14, 15 and 20), as shown in Table 5, high strength hot-rolled steel sheets excellent in press formability, having both an excellent balance between strength and hole expandability (not less than 35,000 MPa % in terms of the value obtained by multiplying a tensile strength by a net hole expansion rate) and an excellent balance between strength and elongation (not less than 18,500 MPa % in terms of the value obtained by multiplying a tensile strength by a total elongation), are obtained.

On the other hand, in the comparative examples (Nos. 3 to 5, 7, 9, 11 to 13 and 16 to 19), since some conditions are outside the range of the present invention as explained at the remarks in Tables 1 to 3, steel sheets having poor mechanical properties (poor properties in a balance between strength and hole expandability and a balance between strength and elongation) are obtained by all means.

The present invention has made it possible to provide, stably and at a low cost, a multi-phase steel sheet excellent in press formability, having both an excellent balance between strength and hole expandability and an excellent balance between strength and elongation, and a method of producing the steel sheet, and, consequently, the ranges of the application and the service conditions have markedly been expanded and the industrial and economical effects of the present invention are remarkable.

The invention claimed is:

1. A hot rolled multi-phase steel sheet excellent in hole expandability characterized in that: the steel sheet contains, as chemical components in mass, C: 0.03 to 0.15%, P: not more than 0.010%, S: not more than 0.003%, Cu: 0.12% or less, either one or both of Si and Al in a total amount of 0.5 to 4%, one or more of Mn, Ni, Cr, and Mo in a total amount of 0.5 to 4%, and further contains the following components (1) or (2); (1) one or more of Nb, V and Ti in a total amount of less than 0.3%; or (2) one or both of Ca of less than 0.01% and REM of less than 0.05%; with the balance being Fe and unavoidable impurities; the microstructure at a section of the steel sheet is composed of retained austenite and martensite which account(s) for 3 to 30% in total in area percentage, where martensite is contained in less than 3% in area percentage, and the balance is either one or both of ferrite and bainite; the maximum length of the crystal grains in the microstructure is not more than 10 microns; the number of inclusions of 20 microns or larger in size at a section of the steel sheet is not more than 0.3 piece per square millimeter; and the steel sheet has a micro Vickers hardness of bainite of less than 240, a balance between strength and elongation is more than 20,000 MPa, a ratio of hole expandability of 94% or more, and wherein Al is present in an amount of 0.1% or less.

2. A hot rolled multiphase steel sheet excellent in hole expandability according to claim 1, wherein the microstructure of the steel is further composed of pearlite which accounts for more than 0% to not more than 3% in area percentage.

3. A hot rolled multi-phase steel sheet excellent in hole expandability according to claim 1, wherein the steel sheet is produced in a hot-rolling process in which the finish-rolling entry temperature is not lower than 960° C. and the finish-rolling exit temperature is between 920° C. and 780° C.

4. A hot rolled multi-phase steel sheet excellent in hole expandability according to claim 1, having a ratio of hole expandability of more than 98%.

5. A hot rolled multi-phase steel sheet excellent in hole expandability according to claim 1, having a ratio of hole expandability of more than 104%.

6. A hot rolled multi-phase steel sheet excellent in hole expandability according to claim 1, wherein Al is present in an amount of 0.04% or less.

* * * * *